US008259143B2

(12) United States Patent
Maebashi

(10) Patent No.: US 8,259,143 B2
(45) Date of Patent: Sep. 4, 2012

(54) IMAGE FORMING APPARATUS

(75) Inventor: Yoichiro Maebashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 470 days.

(21) Appl. No.: 12/613,903

(22) Filed: Nov. 6, 2009

(65) Prior Publication Data

US 2010/0046993 A1 Feb. 25, 2010

Related U.S. Application Data

(62) Division of application No. 11/428,447, filed on Jul. 3, 2006, now Pat. No. 7,636,100.

(30) Foreign Application Priority Data

Jul. 8, 2005 (JP) ..... 2005-199777

(51) Int. Cl.
*B41J 2/385* (2006.01)

(52) U.S. Cl. ..... 347/154

(58) Field of Classification Search ..... None
See application file for complete search history.

(56) References Cited

U.S. PATENT DOCUMENTS

| | | | |
|---|---|---|---|
| 5,922,493 A | 7/1999 | Humphrey et al. | |
| 6,097,925 A | 8/2000 | Nagaoka et al. | |
| 6,101,286 A | 8/2000 | Shimizu et al. | |
| 6,516,179 B1 | 2/2003 | Sawai et al. | |
| 6,724,410 B2 | 4/2004 | Arai | |
| 6,813,471 B2 | 11/2004 | Sawai et al. | |
| 6,983,121 B2 | 1/2006 | Sawai | |
| 2004/0218944 A1 * | 11/2004 | Kawaguchi et al. | 399/90 |
| 2005/0105925 A1 | 5/2005 | Yang et al. | |

FOREIGN PATENT DOCUMENTS

| | | |
|---|---|---|
| JP | 63-247778 | 10/1988 |
| JP | 5-346738 | 12/1993 |
| JP | 7-140758 | 6/1995 |
| JP | 2001-356538 | 12/2001 |
| JP | 2004-045457 | 2/2004 |
| JP | 2004045457 A * | 2/2004 |
| JP | 2004-198901 | 7/2004 |
| JP | 2004-333907 | 11/2004 |

* cited by examiner

*Primary Examiner* — Matthew Luu
*Assistant Examiner* — Kendrick Liu
(74) *Attorney, Agent, or Firm* — Fitzpatrick, Cella, Harper & Scinto

(57) ABSTRACT

A structure for a transport path for a recording material within a transfer portion varies between a margin-less print mode and a normal print mode. A necessity of cleaning of a transfer member also varies between both modes. Thus, provided is an image forming apparatus in which the structure of the transfer portion is switched between the normal print and the margin-less print, and the margin-less print cannot be carried out with a structure of the transfer portion for the normal print. This is because, when the so-called margin-less print is carried out with the structure of the transfer portion for the normal print, there is a possibility that an image defect of a print image to be outputted is caused, or a stain of toner on a rear surface of the recording material is caused.

4 Claims, 9 Drawing Sheets

IMAGE FORMING APPARATUS

This application is a divisional of U.S. patent application Ser. No. 11/428,447, filed Jul. 3, 2006.

BACKGROUND OF THE INVENTION

1. Field of the Invention

The present invention relates to an image forming apparatus for transferring a toner image carried on an image bearing member onto a recording material.

2. Related Background Art

A conventional electrophotographic technology includes a technology for transferring a toner image carried on an image bearing member onto a recording material by passing the recording material between the image bearing member carrying the toner image and a transfer roller.

In the technology, U.S. Pat. No. 6,516,179 discloses a method by which a recording material enters a transfer nip. An image forming apparatus disclosed in U.S. Pat. No. 6,516,179 includes a guide member for guiding the recording material toward a second transfer nip portion of an intermediate transfer belt. By providing the guiding member, a leading edge of the recording material is first brought into contact with the intermediate transfer belt, and then enters the second transfer nip portion in a manner that the recording material passes along the intermediate transfer belt.

On the other hand, in recent yeas, there is more demand for outputting a print including no margin on an edge of a recording material (hereinafter, referred to as "margin-less print") even by the image forming apparatus adopting the electrophotographic technology. A demand for the margin-less print as prints used for a poster, a leaflet, a brochure, a catalogue, a flyer, and the like is emerging. In addition, in the market, there is an increasing demand for an image forming apparatus capable of printing both the margin-less print and a normal print (print with margins on edges thereof).

However, the method in the image forming apparatus disclosed in U.S. Pat. No. 6,516,179, by which the recording material enters the second transfer nip may cause a phenomenon in which the leading edge of the recording material scrapes off the toner image carried on the intermediate transfer belt in the case where the margin-less print is printed. The phenomenon in which the leading edge of the recording material scrapes off the toner image causes an image defect in which an image formed on the leading edge of the recording material is scraped off. In a case where the recording material secures a sufficient margin at the edge of the leading edge side, the image defect is less likely to be caused, but in a case of outputting the print including no margin, the image defect may be caused. Further, as in the image forming apparatus disclosed in U.S. Pat. No. 6,516,179, in a case where a transfer member brought into contact with an intermediate transfer member is used, there may be caused an adverse effect in which toner running out of the edge of the recording material, which is contained in the toner image formed on the intermediate transfer member, is adhered to the transfer member. Then, the toner adhered to the transfer member soils a rear surface of the recording material. In other words, in the case where the margin-less print is printed with the structure of the image forming apparatus disclosed in U.S. Pat. No. 6,516,179, the adverse effect which is not caused in printing a normal print (with margins on the recording material) is caused.

SUMMARY OF THE INVENTION

Therefore, an object of the present invention is to provide an image forming apparatus capable of printing both a margin-less print and a normal print, in which an occurrence of an image defect is suppressed when the margin-less print is printed. Another object of the present invention is to provide the image forming apparatus capable of printing both the margin-less print and the normal print, in which an occurrence of a stain of toner on a rear surface of a recording material is suppressed when the margin-less print is printed.

Still another object of the present invention is to provide an image forming apparatus, including: a transfer unit mount portion configured to be capable of mounting one of a first transfer unit and a second transfer unit, the one of the first transfer unit and the second transfer unit being capable of transferring a toner image onto a recording material when the one of first transfer unit and second transfer unit is mounted on the transfer unit mount portion; and a controller configured to have a first mode for forming the toner image onto the recording material not to provide a margin on any one of edges of the recording material, and a second mode for forming the toner image onto the recording material to provide margins on all the edges around the recording material, for controlling to make it possible to carry out the first mode when the first transfer unit is mounted on the transfer unit mount portion, and controlling to make it possible to carry out the second mode and inhibiting carrying out the first mode when the second transfer unit is mounted on the transfer unit mount portion.

Yet another object of the present invention is to provide an image forming apparatus, including: an image bearing member configured to carry a toner image; a transfer member configured to transfer the toner image onto a recording material from the image bearing member; a cleaning member configured to clean toner on the transfer member; and a controller configured to have a first mode for forming the toner image onto the recording material not to provide a margin on any one of edges of the recording material, and a second mode for forming the toner image onto the recording material to provide a margin at an entire circumferential edge of the recording material, perform controlling such that the cleaning member to be brought into contact with the transfer member when the first mode is carried out, and perform controlling such that the cleaning member not to be brought into contact with the transfer member when the second mode is carried out.

Further another object of the present invention is to provide an image forming apparatus, including: an image bearing member configured to carry a toner image; a controller configured to have a first mode for forming the toner image onto a recording material not to provide a margin on any one of edges of the recording material, and a second mode for forming the toner image onto the recording material to provide margins on all the edges around the recording material; and a guide member configured to guide a conveyance of the recording material, for guiding the recording material to a transfer area in which the toner image is transferred from the image bearing member to the recording material, and being capable of having a first posture and a second posture, the guide member having the first posture in the first mode and having the second posture in the second mode. In the image forming apparatus, when the guide member has the first posture, the guide member guides a leading edge of the recording material not to be brought into contact with a surface of the image bearing member before the leading edge of the recording material enters the transfer area, and when the guide member has the second posture, the guide member guides the leading edge of the recording material to be brought into contact with the surface of the image bearing member before the leading edge of the recording material enters the transfer area.

Another object of the present invention is to provide an image forming apparatus, including: an image bearing member configured to carry a toner image; and a transfer unit mount portion configured to be capable of mounting one of a first transfer unit and a second transfer unit. In the image forming apparatus, the first transfer unit includes a first transfer member for forming the image bearing member and a first transfer area and transferring a toner image onto a recording material entering the first transfer area. The second transfer unit includes a second transfer member for forming the image bearing member and a second transfer area and transferring the toner image onto the recording material entering the second transfer area. In a case where the first transfer unit is mounted on the transfer unit mount portion, a leading edge of the recording material is not brought into contact with a surface of the image bearing member until the leading edge of the recording material enters the first transfer area. In a case where the second transfer unit is mounted on the transfer unit mount portion, the leading edge of the recording material is brought into contact with the surface of the image bearing member before the leading edge of the recording material enters the second transfer area.

Other objects of the present invention will be described below.

DESCRIPTION OF THE PREFERRED EMBODIMENTS

Hereinafter, an image forming apparatus according to the present invention will be descried in detail with reference to the drawings.

First Embodiment

In this embodiment, an image forming apparatus having a normal print mode (first mode) in which margins are provided on a recording material, and a margin-less print mode (second mode) is structured such that a transfer unit is provided in a replaceable manner. A user may use the image forming apparatus by replacing a transfer unit used for a margin-less print with a transfer unit used for prints other than the margin-less print (normal print), thereby optimizing a printing cost and image quality. In addition, the quality of the margin-less print image is improved, and favorable image quality and a low printing cost are maintained also in the print mode for the prints other than the margin-less print. It should be noted that the normal print mode (also referred to as "normal mode") is a mode for providing margins on all the edges around the recording material, and the margin-less print mode is a mode for providing no margin to any edge of the recording material. Further, the margin-less print is a print in which no margin is provided to any edge of the recording material.

Figure 1:
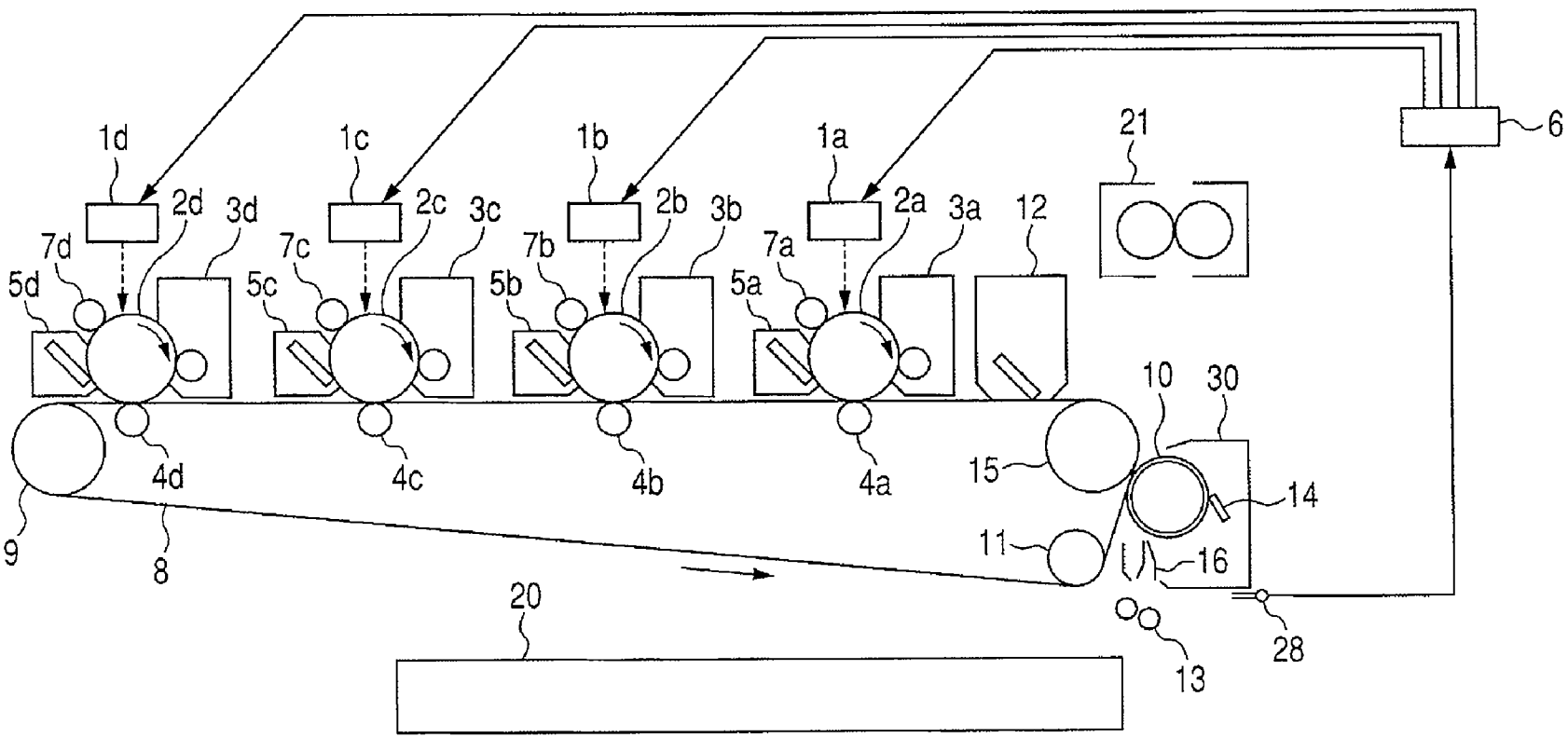
FIG. 1 is a cross-sectional diagram of an overall structure of an image forming apparatus according to a first embodiment of the present invention.

FIG. 1 is a schematic diagram of a structure of a color image forming apparatus adopting an intermediate transfer system as the image forming apparatus according to this embodiment. In this embodiment, used is a color image forming apparatus adopting an inline intermediate transfer system, in other words, a tandem type color image forming apparatus for forming toner images of each color in a plurality of image forming portions each including an image bearing member.

The image forming apparatus shown in FIG. 1 forms electrostatic latent images on photosensitive members 2 in the image forming portions for a plurality of colors provided along an intermediate transfer belt 8 based on image input data. Thus formed electrostatic latent images are developed by using monochromatic toner of each color, thereby forming monochromatic toner images. The monochromatic toner images formed in the respective image forming portions are superimposed on one another on the intermediate transfer belt 8 to obtain a multiple (multicolor) toner image. The multiple toner image is transferred onto the recording material, and the multiple toner image formed on the recording material is fixed by a fixing device 21.

In each image forming portion, drum-type photosensitive members (photosensitive drums) 2 (2*a*, 2*b*, 2*c*, and 2*d*) are arranged in a line. On a periphery of each of the photosensitive drums 2, arranged as means for forming a toner image are charging rollers 7 (7*a*, 7*b*, 7*c*, and 7*d*) serving as primary charging means, exposure devices 1 (1*a*, 1*b*, 1*c*, and 1*d*), developing devices 3 (3*a*, 3*b*, 3*c*, and 3*d*) constituting developing means, and photosensitive drum cleaning blades 5 (5*a*, 5*b*, 5*c*, and 5*d*). The photosensitive drums 2 for each color are rotationally driven by a drive unit (not shown).

Lower parts of the photosensitive drums 2 for each color are brought into contact with primary-transfer rollers 4 (4*a*, 4*b*, 4*c*, and 4*d*) respectively serving as transfer members through the endless intermediate transfer belt 8 serving as an image bearing member in each primary-transfer area. The intermediate transfer belt 8 is looped around a second transfer opposing roller 15, a tension roller 9, and a pre-second transfer stretching roller 11 that also serve as drive rollers. The intermediate transfer belt 8 is rotated in a direction indicated by the arrow.

Paper (recording material) transported from a sheet feeding cassette 20 is guided by a pre-transfer guide 16 from a pair of pre-second transfer transport rollers 13 to a second transfer area which is formed by a second transfer roller 10 and the intermediate transfer belt 8. Then, a toner image formed on the intermediate transfer belt 8 is transferred onto a recording material P, and is fixed on the recording material P by a fixing device 21 with pressure and heat, thereby making it possible to obtain a fixed toner image. On the other hand, a toner image (waste toner) which cannot be transferred onto the recording material P in the second transfer area, thereby being left on the intermediate transfer belt 8 is cleaned by an intermediate transfer member cleaner 12.

In this embodiment, as each photosensitive drum 2 in the image forming portions of respective colors, a negative charge type photosensitive drum 2 having a diameter of 30 mm is used, and a charging bias in which an AC component is superimposed on a DC component is applied to charging rollers 7, thereby uniformly charging the photosensitive drums 2 at a voltage of about −650 V. The exposure devices 1 each include a near-infrared laser diode having a wavelength of 760 nm (not shown) and a polygon scanner for scanning the photosensitive drums 2 with a laser beam, and lower an electric potential of the image forming portion to a voltage of −250 V (thereby forming an electrostatic latent image based on image data). The developing devices 3 are contact developing devices using non-magnetic one-component toner for a developer, and the electrostatic latent image formed on the photosensitive drums 2 is developed by being brought into contact with the toner. The primary-transfer roller 4 is driven to be rotated by a friction caused between the primary-transfer roller 4 and a rear surface of the intermediate transfer belt 8. A cored bar of the primary-transfer roller 4 is applied with a primary-transfer voltage of 300 V, and the toner image formed on the photosensitive drum 2 is primarily transferred onto the intermediate transfer belt 8.

The second transfer opposing roller 15 is formed of a cored bar having a diameter of 30 mm which is coated with EPDM rubber having a thickness of 500 μm whose resistance is adjusted by carbon black. The tension roller 9 is a hollow tube made of aluminum having a diameter of 30 mm, has a spring at a both-end bearing portion thereof, and the belt is looped around the tension roller 9 under tension at a total pressure of 40 N. Further, the pre-second transfer stretching roller 11 is a roller made of stainless steel having a diameter of 20 mm, and is driven to be rotated by the friction between the rear surface of the intermediate transfer belt 8 and the pre-second transfer stretching roller 11. In this embodiment, the intermediate transfer belt 8 is a single-layered endless (seamless) resin belt having a thickness of 75 μm, a perimeter of 1000 mm, and a length of 320 mm in a longitudinal direction thereof (image forming width direction), and is formed of polyimide whose resistance is adjusted by carbon dispersion.

Next, a second transfer process is described. A second transfer portion of the image forming apparatus according to this embodiment is unitized as a transfer unit 30, which can be replaced by a user. The transfer unit 30 is fit into a predetermined position within the image forming apparatus by fixing the transfer unit on a transfer unit mount portion 27 (see FIGS. 3A and 3B). The image forming apparatus according to this embodiment has a margin-less print mode as well as a normal print mode. As the transfer unit 30, a transfer unit 30A used for the margin-less print and a transfer unit 30B used for the normal print (prints other than the margin-less print) are separately prepared (see FIGS. 2A and 2B). Further, a switch 28 for discriminating the transfer unit is provided to a main body of the image forming apparatus. When the transfer unit 30A is mounted on the transfer unit mount portion 27, the switch 28 is pressed and a signal indicating that the transfer unit 30A is mounted on the transfer unit mount portion 27 is transmitted to a controller 6. On the other hand, when the transfer unit 30B is mounted on the transfer unit mount portion 27, the switch 28 is not pressed and a signal indicating that the transfer unit 30A is not mounted on the transfer unit mount portion 27 is transmitted to the controller 6 from the switch 28 (see FIGS. 3A and 3B).

Figure 2B:
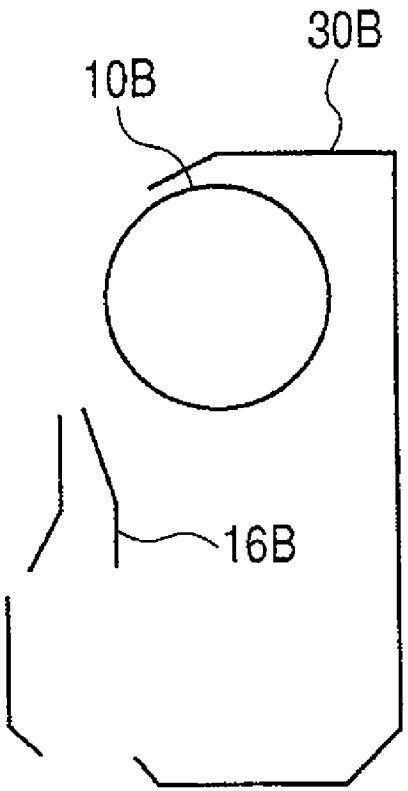
FIG. 2B is an explanatory diagram of a transfer unit for a normal print according to the first embodiment.
Figure 2A:
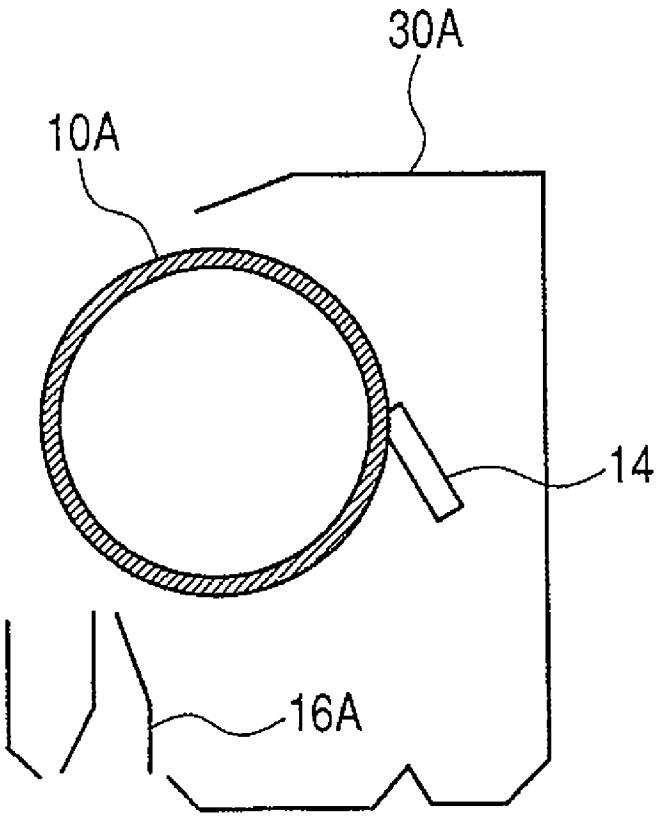
FIG. 2A is an explanatory diagram of a transfer unit for a margin-less print according to the first embodiment.

Next, the transfer unit according to this embodiment is described with reference to FIGS. 2A and 2B. In FIGS. 2A and 2B, reference symbol 30A denotes a transfer unit for a margin-less print and reference symbol 30B denotes a transfer unit for a normal print.

First, the transfer unit for the margin-less print shown in FIG. 2A is described. The transfer unit 30A includes a pre-transfer guide 16A which is a recording material regulating member for regulating a second transfer roller 10A and a transport path for a recording material, and a blade-type second transfer roller cleaner 14.

Figure 4B:
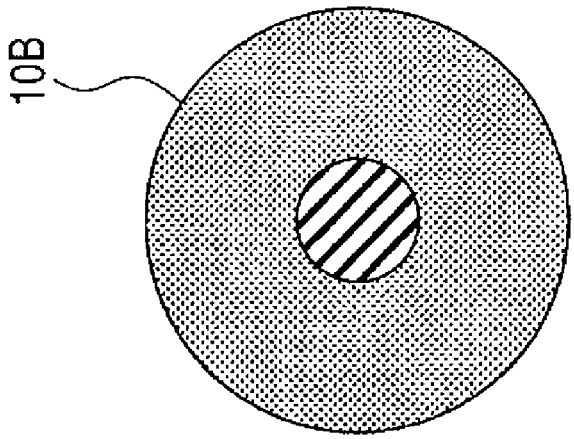
FIG. 4B is an explanatory diagram of a transfer roller for the normal print according to the first embodiment.
Figure 4A:
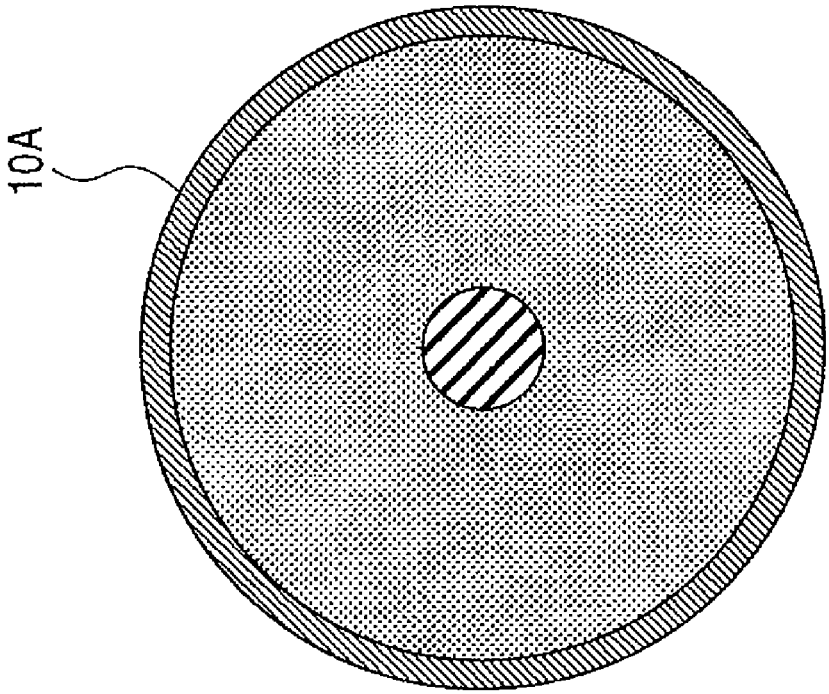
FIG. 4A is an explanatory diagram of a transfer roller for the margin-less print according to the first embodiment.

As shown in FIG. 4A, an elastic layer of the second transfer roller 10A is formed of foamed hydrin rubber having a thickness of about 13 mm from the cored bar side, and urethane coating applied thereon by dispersing powdery PVDF having a size of about 20 μm. Ten point height of irregularities (Rz) of a surface of a surface layer coating is set to 5 μm. A surface roughness of the second transfer roller 10A is set to be smaller than a surface roughness (about 200 μm) of the second transfer roller 10A used for the transfer unit 30A for the normal print to be described below. The setting is employed so that a cleaning performance of the second transfer roller 10A is preferably performed.

A hardness of the second transfer roller 10A is an Asker C hardness of 35° in a load-state of 500 g, which is larger than a hardness (30°) of a second transfer roller 10B for the normal print (see FIG. 4B). This setting is employed so that the cleaning performance of the second transfer roller 10A is preferably performed. It should be noted that when the hardness of the transfer roller becomes higher, there is a possibility that a deterioration in transfer efficiency of rough paper (paper having large paper fibers and a rough surface shape) is caused. However, there are many cases where the paper having a preferable surface property such as coated paper is used for the margin-less print, so setting is effected (the hardness of the transfer roller is set to be higher) such that more emphasis is placed on the cleaning performance of the transfer roller than on an improvement of the transfer efficiency of the rough paper.

The blade-type second transfer roller cleaner 14 has a structure in which a plate-like blade made of polyurethane rubber is brought into contact with the second transfer roller by a pressure spring (not shown) at a linear pressure of 30 N/m.

The pre-transfer guide 16A serving as the recording material regulating member for regulating the transport path for the recording material is formed of a stainless sheet metal having a thickness of 1 mm. The pre-transfer guide 16A is set in a shape/position for regulating the paper transport path so that the leading edge of the recording material (paper) enters the transfer area along the second transfer roller 10A after the recording material is brought into contact with the second transfer roller 10A. The reason for regulating the paper transport path is described later.

Next, the transfer unit for the normal print shown in FIG. 2B is described. The transfer unit 30 is constituted of the pre-transfer guide 16 serving as the recording material regulating member for regulating the second transfer roller 10 and the transport path for the recording material.

As shown in FIG. 4B, a second transfer roller 10B is formed of a cored bar having a diameter of 14 mm coated with foamed hydrin rubber in a thickness of about 4 mm, and has an outer diameter of 22 mm. Ten point height of irregularities (Rz) of a surface of the second transfer roller 10B is set to about 200 μm. A hardness of the second transfer roller 10B is an Asker C hardness of 30° in a load-state of 500 g, which is a hardness lower than that of the second transfer roller 10A for the margin-less print. By the settings, the transfer efficiency of rough paper is preferably maintained. It should be noted that the second transfer roller 10B has no covering layer on a surface thereof, thereby making an effect that the hardness thereof is maintained to be lower. Further, because the second transfer roller 10B has no covering layer on a surface thereof, there is an effect of reducing the stain of the toner on the rear surface of the recording material. This is because a small amount of toner adhered to the second transfer roller 10B is absorbed into cells of a sponge. The small amount of toner temporarily adhered to the second transfer roller 10B is thus absorbed in the cells of the sponge. On the other hand, in a case where the second roller has the covering layer similarly to the second transfer roller 10A, and includes no cleaning device 14, almost all the toner temporarily adhered to the second transfer roller 10A is adhered to the recording material when the toner is subsequently brought into contact with the recording material. As compared with the second transfer roller 10B, the second transfer roller 10A has less irregularities on the surface thereof. Note that the toner adhered to the surface of the second transfer roller 10B is removed from the second transfer roller 10B by a bias cleaning operation during the image forming operation.

The pre-transfer guide 16B is set in a shape/position for regulating the paper transport path so that the recording material (paper) enters the transfer area along the transfer belt after the recording material (paper) is brought into contact with the intermediate transfer belt. By the setting, a transfer scattering (blur) and a void (white spot) are prevented. In particular, in the normal print, it is assumed that a large amount of document images mainly constituted of text is printed in an office environment or the like, so it is necessary to maintain a satisfactory character quality. Thus, it is desirable that the paper transport path is set so as to prevent the transfer scattering.

The transfer unit for the normal print is structured as described above. By providing the transfer unit 30B for the normal print in addition to the above-mentioned transfer unit 30A, there is an effect in reducing a manufacturing cost while maintaining the image quality. As described above, for the transfer unit 30B for the normal print, a second transfer roller 10B having a small radius and a simple structure is used, so the manufacturing cost thereof is lower than the second transfer roller 10A. In addition, the transfer unit 30B has no transfer blade 14, thereby reducing the cost thereof due to the structure. As mentioned above, in the transfer roller 10B of the transfer unit 30B, wear degradation due to the transfer blade 14 is not caused, and a duration of life thereof is long, so a running cost of the transfer unit 30B is also lower than that of the second transfer roller 10A. As a result, in the image forming apparatus, in a case where the margin-less images are to be output as normal images, the optimum unit for the images may be selected and be mounted thereon, thereby achieving the low cost.

In the image forming apparatus according this embodiment, a user selects one unit of the above-mentioned two transfer units and mounts the unit thereon, thereby performing the printing. When printing the margin-less print, the transfer unit for the margin-less print is selected to be mounted thereon, and when printing the prints other than the margin-less print, the transfer unit for the normal print is selected to be mounted thereon.

Figure 3B:
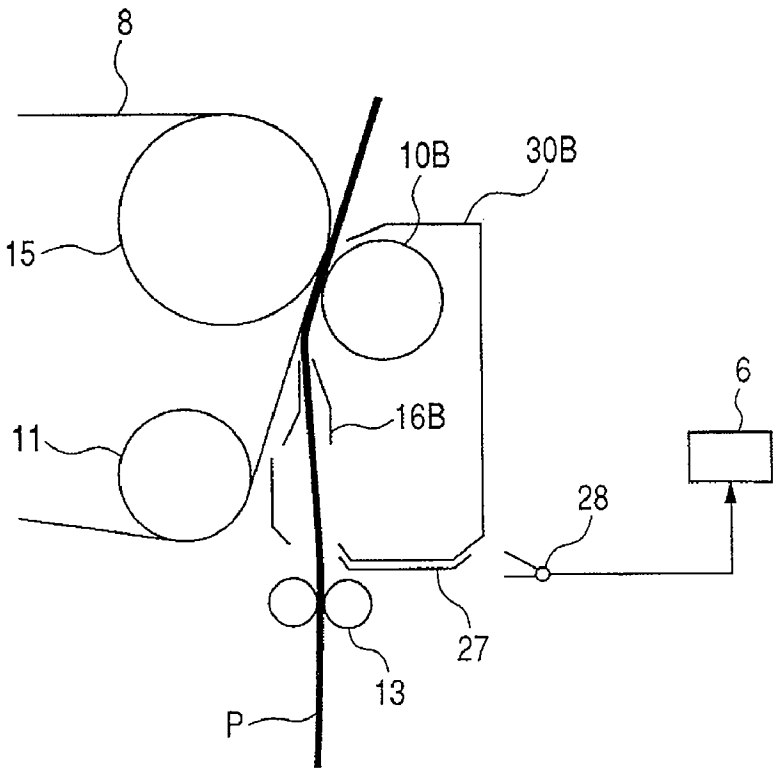
FIG. 3B is an explanatory diagram of the recording material transport path according to the first embodiment.
Figure 3A:
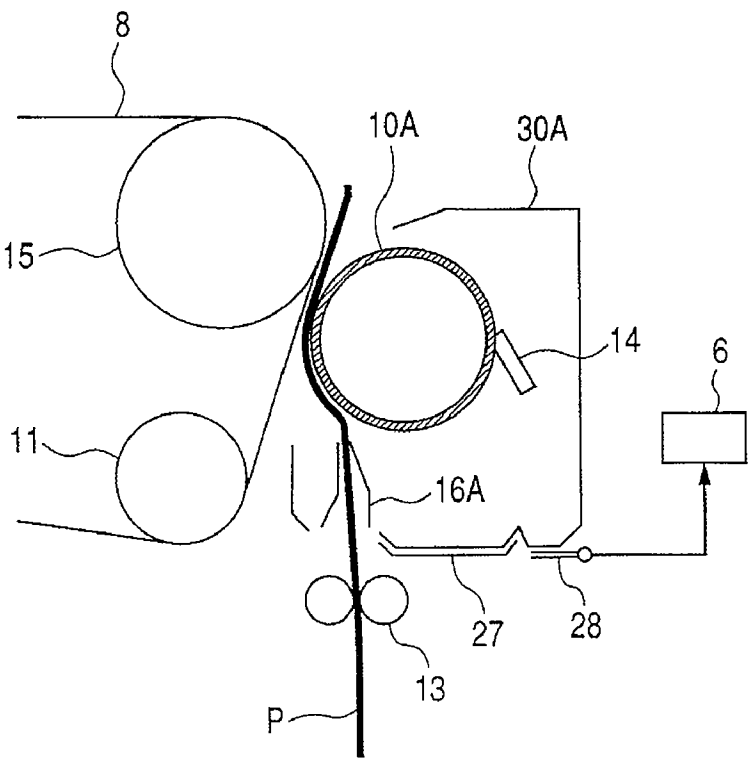
FIG. 3A is an explanatory diagram of a recording material transport path according to the first embodiment.

FIGS. 3A and 3B are explanatory diagrams of the recording material transport path in a case where each of the transfer units is mounted on the main body to perform the second transfer.

FIG. 3A shows a recording material transport path in a case where the transfer unit for the margin-less print is mounted on the main body, and FIG. 3B shows a recording material transport path in a case where the transfer unit for the normal print is mounted on the main body. In FIGS. 3A and 3B, reference symbol P denotes a recording material, and when the transfer unit for the margin-less print is mounted on the main body, the recording material P is brought into contact with the second transfer roller 10A, and then enters the transfer area along the second transfer roller 10A. Further, when the transfer unit for the normal print is mounted on the main body, the recording material P is brought into contact with the intermediate transfer belt 8, and then enters the transfer area along the transfer belt. The paper transport paths are provided for preventing the image defect to be described below.

The image defect is caused when the leading edge of the recording material P scrapes off the toner image carried on the intermediate transfer belt 8. This is a phenomenon in which the leading edge of the recording material P is brought into contact with the toner image carried on the intermediate transfer belt 8 before the leading edge of the recording material P enters the nip area, thereby scraping off the toner image to be transferred subsequently. By the phenomenon, there are caused two image defects, that is, the image defect due to scraping off of the toner image itself, and the image defect due to the stain of the toner on the leading edge of the recording material P.

A mechanism of causing the image defects is described in detail. In a case where the transfer unit 30B for the normal image is mounted on the main body, the recording material is brought into contact with the toner image carried on the intermediate transfer belt 8 before the recording material enters the transfer area. With this structure, the occurrence of the image defect depends on a transport speed control of the recording material and setting of an approach angle of the recording material with respect to the intermediate transfer belt. As an example for easier understanding, described is a case where a position at which the recording material is brought into contact with the intermediate transfer belt deviates from a predetermined position to an upstream side of a movement direction of the intermediate transfer belt.

The case where the recording material is brought into contact with the intermediate transfer belt at the upstream side of the movement direction thereof means that the recording material bypasses the path through which the recording material is originally transported. When the recording material bypasses to be brought into contact with the intermediate transfer belt, the intermediate transfer belt and the recording material move together, so the toner image carried on the intermediate transfer belt precedes the recording material which has bypassed. Then, the leading edge of the recording material is brought into contact with the intermediate transfer belt at a rear side in the movement direction of the intermediate transfer belt compared to the predetermined position at which the leading edge of the recording material is brought into contact with the intermediate transfer belt. Further, when the leading edge of the recording material moves to the transfer area while being in contact with the intermediate transfer belt 8, the toner image carried on the intermediate transfer belt 8 is scraped off by the leading edge of the recording material in the process in which the intermediate transfer belt and the recording material reach the transfer area. This is because, when the recording material reaches the transfer area, relative positions of the recording material and the toner image carried on the intermediate transfer belt are set in the predetermined positions, thereby eliminating the path around which the recording material bypasses. In other words, the recording material and the toner image carried on the intermediate transfer belt are misaligned to be in contact with each other, but in the process of transportation, the posture of the recording material is corrected, and the misalignment is resolved little by little, thereby scraping off the toner image carried on the intermediate transfer belt by the leading edge of the recording material in the process.

On the other hand, in a case where the transfer unit 30A for the margin-less print is mounted on the main body, the leading edge of the recording material which is transported to slide onto the second transfer roller 10A is guided into the transfer area without being brought into contact with the intermediate transfer belt 8, so the above-mentioned image defect does not occur. The effect is remarkable particularly in the case of the margin-less print. This is because the toner image formed in the vicinity of the leading edge of the recording material is not disturbed in the process of transferring. In the image forming apparatus according to this embodiment, it is possible to obtain a toner image that is clearly formed even on the edge of the recording material in the case where the transfer unit 30A for the margin-less print is used.

The second transfer roller 10A is formed of a cored bar having a diameter of 14 mm which is coated with an elastic layer of a two-layer structure, and has an outer diameter of 40 mm. The outer diameter of the second transfer roller 10A is set to be larger than the outer diameter (22 mm) of the second transfer roller used for the transfer unit for the normal print to be described later. The reason for this structure is described as follows.

A first reason is that, in the case of the margin-less print, it is required that the leading edge of the recording material (paper) is allowed to enter the transfer area being stable along the second transfer roller 10A. In other words, the reason is that, when the outer diameter of the second transfer roller 10A is large, it is possible to feed the paper stably along the second transfer roller 10A.

A second reason is that, when the perimeter of the second transfer roller 10A is large, the number of opportunities for the surface of the second roller 10A to be brought into contact with the second transfer roller cleaner 14 is reduced, thereby making it possible to prevent the wear of the second transfer roller 10A. Hereinafter, the first and second reasons are described in more detail.

The above-mentioned first reason is described below in detail. The first reason is due to the paper transport path in the case of the margin-less print. In the case of the margin-less print, the paper transport path is regulated such that the leading edge of the recording material (paper) enter the transfer area along the second transfer roller 10A after being brought into contact with the second transfer roller 10A, thereby preventing a blurred image and rubbing of an image. It is preferable that the paper be allowed to enter the transfer area along a tangent of the second transfer roller 10A, thereby smoothly passing along the second transfer roller 10A. However, the fact is that it is difficult to allow the paper to enter the transfer area so as to completely match the tangent of the second transfer roller 10A. For this reason, the leading edge of the paper is allowed to enter the transfer area while being inclined toward the second transfer roller 10A, and the leading edge of the paper is allowed to be guided by the second transfer roller 10A. In this case, when the diameter of the second transfer roller 10A is small, in a case where the inclination of the paper toward the second transfer roller 10A is a little large, an angle formed between a circumference of the second transfer roller 10A and an admission line of the paper becomes too large. As a result, the paper is caused to heavily collide with the second transfer roller 10A, so a behavior of the leading edge of the paper becomes unstable. When the behavior of the leading edge of the paper becomes unstable, paper conveyance becomes unstable or an image defect is caused. On the other hand, when the diameter of the second transfer roller 10A is sufficiently large, even in the case where the paper is inclined in some degree toward the second transfer roller 10A, the angle formed between the circumference of the second transfer roller 10A and the admission line of the paper is maintained to be small. In this case, the paper is smoothly brought into contact with the surface of the second transfer roller 10A and then enters the transfer area. Thus, because the diameter of the second transfer roller 10A is sufficiently large, the paper conveyance in the case of the margin-less print is stably performed.

The second reason is related to a durability of the second transfer roller 10A. The second transfer roller 10A used for the margin-less print is brought into contact with the second transfer roller cleaner 14 so that a residual toner running out of the recording material on the intermediate transfer belt is prevented from adhering to the second transfer roller 10A to cause the stain of toner on a rear surface of a recording material. As a result, due to the rubbing caused by the second transfer roller cleaner 14, an abrasion or a damage on the second transfer roller 10A is likely to be caused, thereby shortening a life of the second transfer roller 10A. When the life of the second transfer roller is shortened, the life of the transfer unit 30A is also shortened, thereby causing an increase in printing cost. In order to alleviate this problem, in other words, in order to reduce the abrasion on the surface of the second transfer roller 10A, the outer diameter of the second transfer roller 10A is set to be large.

Further, as another reason, by setting the outer diameter of the transfer roller to be large, it is possible to prevent the transfer scattering (blur) and the void (white spot). In the transfer unit for the margin-less print, the paper is allowed to enter from the transfer roller side, so the transfer scattering (blur) and the void (white spot) are more likely to be caused. Thus setting the outer diameter of the transfer roller to be large is also effective in reducing the above-mentioned image defect. This is because a strength of an electric field generated between the second transfer roller 10A and the intermediate transfer belt 8 is suppressed to be low by setting the outer diameter of the transfer roller to be large.

Next, a function of the controller 6 of the image forming apparatus according to this embodiment is described below. The controller 6 determines whether the transfer unit 30A for the margin-less print is mounted on the transfer unit mount portion 27, or the transfer unit 30B for the normal print is mounted on the transfer unit mount portion 27. The determination of the controller 6 is performed based on a signal from the switch 28. When determining that the transfer unit 30A for the margin-less print is mounted on the transfer unit mount portion 27, the controller 6 controls the image forming apparatus so that both the margin-less print and the normal print can be outputted. For example, in a case where the image signal inputted to the image forming apparatus is larger than that of the recording material selected for the image forming apparatus, toner images one size larger than the recording material are formed on the photosensitive drums 2*a*, 2*b*, 2*c*, and 2*d* by the exposure devices 1*a*, 1*b*, 1*c*, and 1*d*. The toner images formed on the photosensitive drums 2*a*, 2*b*, 2*c*, and 2*d* are superimposed on one another on the intermediate transfer belt 8, and are transferred onto the recording material from the intermediate transfer belt 8. The toner images superimposed on one another on the intermediate transfer belt 8 are larger than the recording material, so the toner image of a part of a region of the toner image formed on the intermediate transfer belt 8 is transferred onto the recording material. As described above, since the toner image one size larger than the recording material is formed on the intermediate transfer belt, the toner image fringing the recording material is not transferred onto the recording material but is transferred onto the second transfer roller 10A. The toner transferred onto the second transfer roller 10A is removed from the second transfer roller 10A by the second transfer roller cleaner 14. By the image forming process, the toner image is formed on an entire area of the recording material without providing a margin to the edge of the recording material.

When determining that the transfer unit 30B for the normal print is mounted on the transfer unit mount portion 27, the controller 6 controls the image forming apparatus so that only the normal image can be outputted. For example, the image signal inputted to the image forming apparatus is larger than that of the recording material selected for the image forming apparatus, the controller 6 issues a warning that the margin-less print cannot be printed to the user. In other words, the controller 6 issues a notice that the margin-less print is inhibited to the user. In a case where the user attempts to carry out the margin-less print even when the user receives the notice that the margin-less print is inhibited, the exposure area for each of the exposure devices 1*a*, 1*b*, 1*c*, and 1*d* is narrowed to forcibly provide margins, thereby performing the normal image formation. That is, the margin-less print is forcibly inhibited. This is because the transfer unit 30B for the normal print is not provided with a cleaner for cleaning the toner adhered to the second transfer roller 10B, thereby causing a failure in which the toner is adhered to the rear surface of the recording material in a case where the second transfer roller 10B is contaminated with the toner running out of the recording material.

As described above, according to this embodiment, the image forming apparatus having the margin-less print mode is mounted with the transfer unit which is replaceable. In addition, the image forming apparatus is structured such that the user can exchangeably use the transfer unit used for the margin-less print and the transfer unit used for the prints other than the margin-less print (normal print). As a result, the quality of the margin-less print image is improved, and the preferable image quality and the low printing cost are maintained even in the mode of the prints other than the margin-less print (hereinafter, referred to as "normal print mode").

Second Embodiment

Figure 7B:
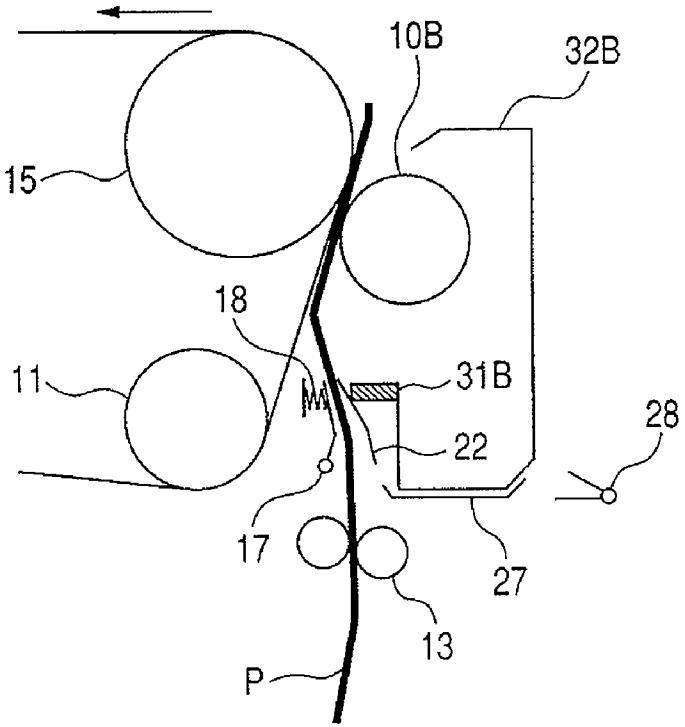
FIG. 7B is an explanatory diagram of the recording material transport path according to the second embodiment.
Figure 7A:
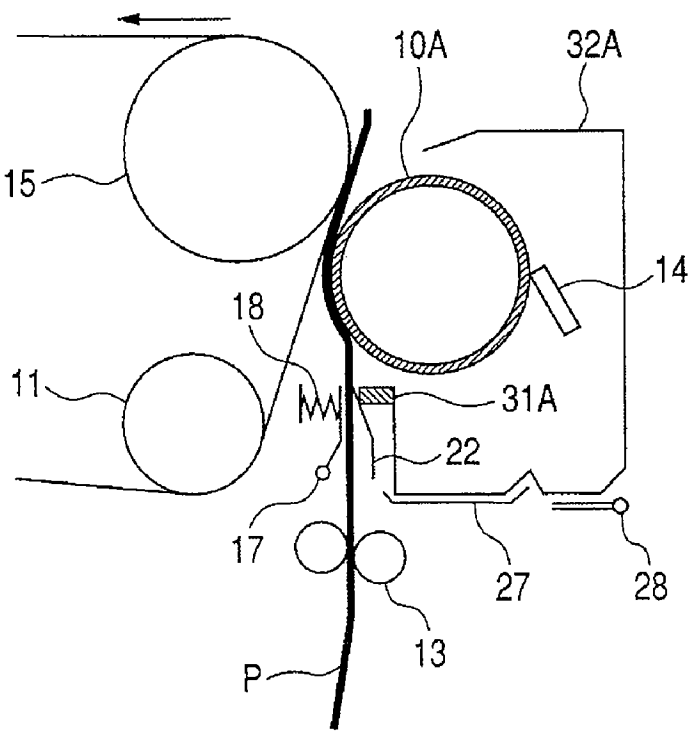
FIG. 7A is an explanatory diagram of a recording material transport path according to the second embodiment.

As shown in FIGS. 7A and 7B, transfer units 32A and 32B according to this embodiment includes no pre-second transfer guide. A pre-second transfer guide 22 is included in the main body of the image forming apparatus. The transfer unit 32A is replaced with the transfer unit 32B, thereby determining the posture of the pre-second transfer guide 22 (recording material regulating member).

Figure 5:
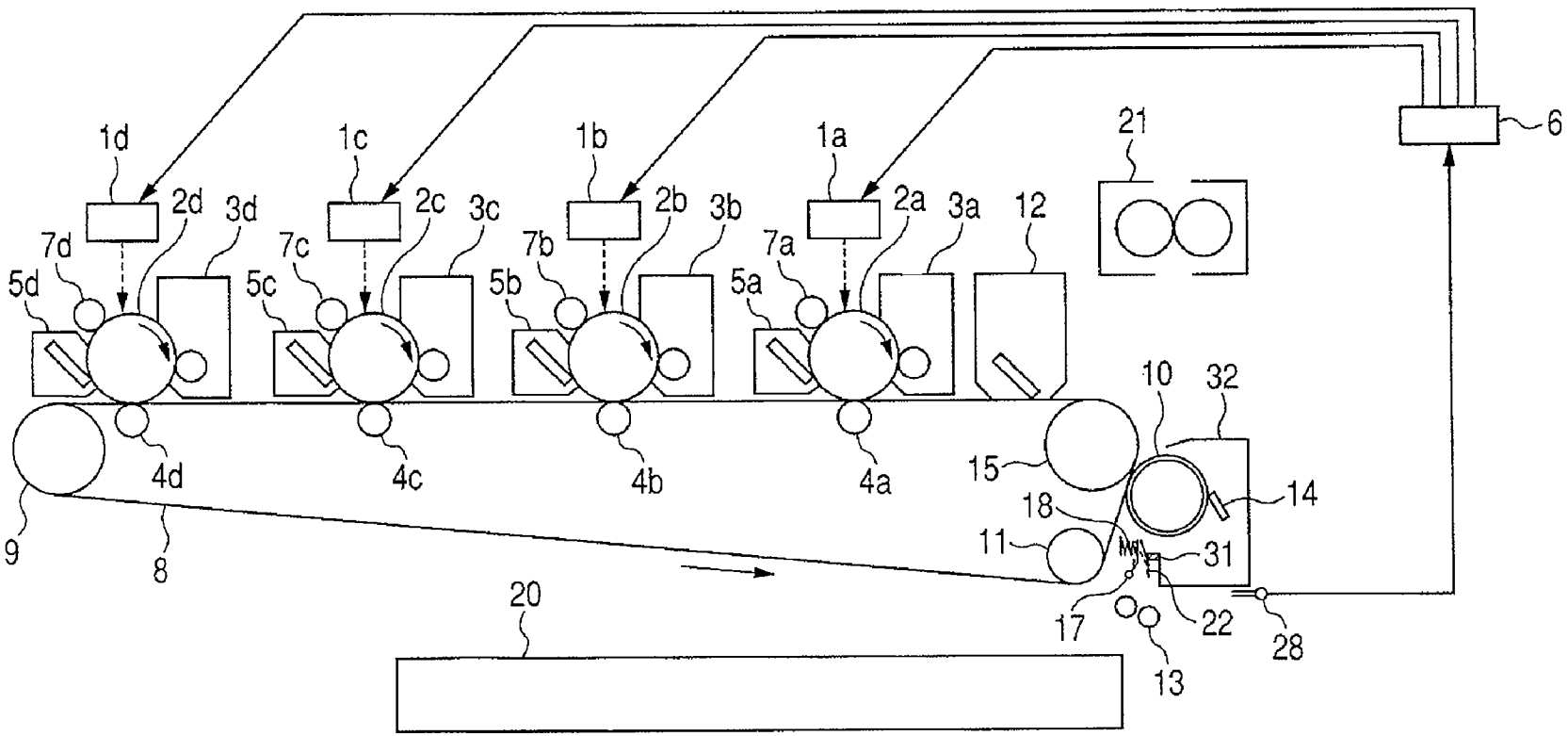
FIG. 5 is a cross-sectional diagram of an overall structure of an image forming apparatus according to a second embodiment of the present invention.

FIG. 5 is a schematic diagram of the structure of the image forming apparatus according to this embodiment. The same reference symbols are given to the members that are identical with those of the image forming apparatus shown in FIG. 1 according to the first embodiment, and the repeated explanation thereof is omitted. In this embodiment, the image formation is also performed as in the case of the image forming apparatus according to the first embodiment. In other words, by the image forming process, toner images are formed on each surface of the photosensitive drums 2 in image forming portions. The thus formed toner images are superimposed on one another and transferred onto the intermediate transfer belt 8 in each image forming portion to be secondarily transferred onto a recording material. Then, the thus transferred toner images are fixed on the recording material, thereby being outputted as an image-formed matter.

Figure 6B:
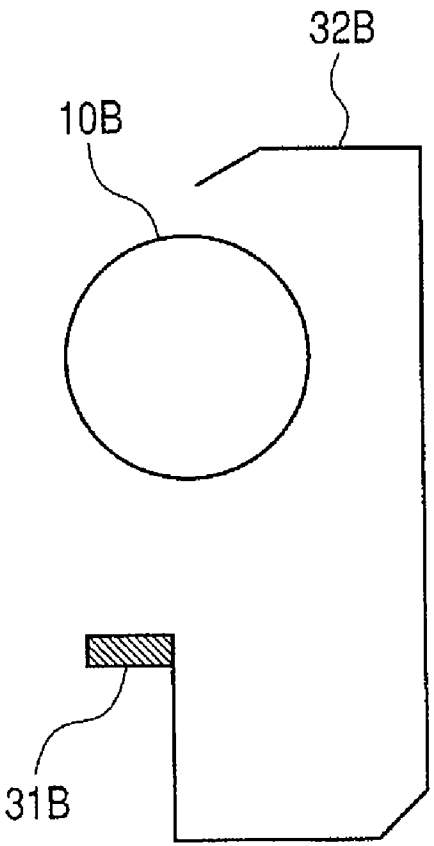
FIG. 6B is an explanatory diagram of a transfer unit for the normal print according to the second embodiment.
Figure 6A:
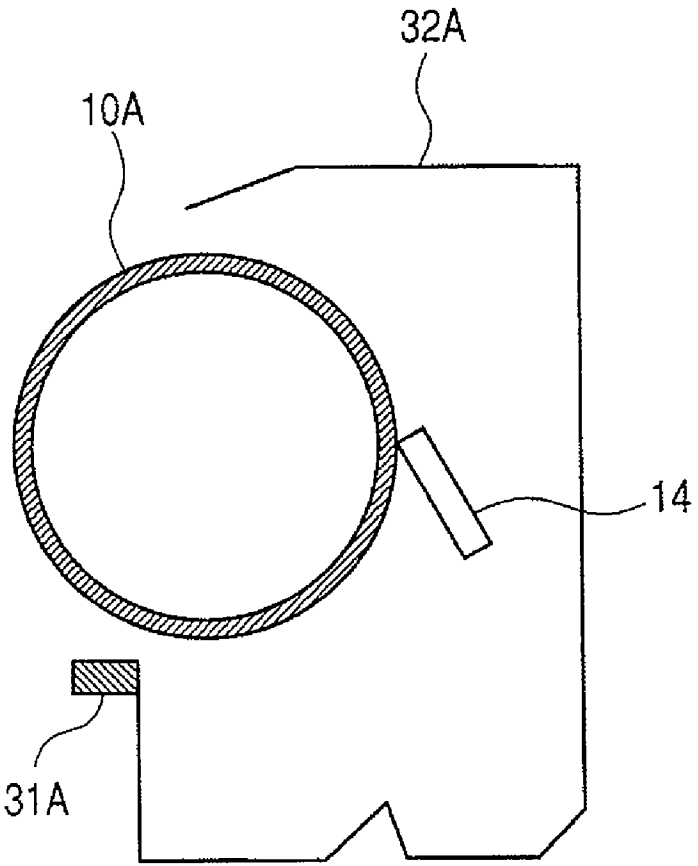
FIG. 6A is an explanatory diagram of a transfer unit for the margin-less print according to the second embodiment.

As shown in FIGS. 6A and 6B, second transfer portions of the image forming apparatus according to this embodiment are unitized as the transfer unit 32 (32A and 32B), and can be replaced with each other by the user. Further, the image forming apparatus according to this embodiment also has the margin-less print mode. The transfer unit 32A serves as the transfer unit for the margin-less print, and the transfer unit 32B serves as the transfer unit for the normal print.

In addition, as shown in FIGS. 7A and 7B, in the image forming apparatus according to this embodiment, the pre-transfer guide 16 serving as the recording material regulating member for regulating the path for the recording material is arranged in the main body of the image forming apparatus, and is swingably mounted about a swingable rotation axis 17. Further, the pre-transfer guide 16 is pressurized in a right rotating direction by a pre-transfer guide pressure spring 18. When the transfer unit 32 is mounted on the main body, the pre-transfer guide 16 is set in a predetermined position by a pre-transfer guide positioning member 31 mounted on the transfer unit 32 and the pre-transfer guide pressure spring 18.

Next, the transfer units according to this embodiment are described with reference to FIGS. 6A and 6B. First, a transfer unit for the margin-less print shown in FIG. 6A is described. The transfer unit 32A includes the second transfer roller 10A and the blade-type second transfer roller cleaner 14. In addition, the transfer unit 32A is mounted with a pre-transfer guide positioning member 31A. The second transfer roller 10A is similar to the second transfer roller used for the transfer unit for the margin-less print according to the first embodiment. In other words, a second transfer roller suitable for the margin-less print is adopted. An outer diameter of the second transfer roller of this case is 40 mm, which is larger than the outer diameter (22 mm) of the second transfer roller used for the normal print. The reason for this is as described in the first embodiment. The blade-type second transfer roller cleaner has a structure in which a plate-like blade made of polyurethane rubber is brought into contact with the second transfer roller at a linear pressure of 30 N/m by a pressure spring (not shown).

Next, a transfer unit for the normal print shown in FIG. 6B is described. The transfer unit 32B is mounted with the secondary roller 10B and a pre-transfer guide positioning member 31B. The pre-transfer guide positioning member 31B presses the pre-transfer guide 16. The shape of the pre-transfer guide positioning member 31B is different from that of the pre-transfer guide positioning member 31A, so the posture of the pre-transfer guide 16 in a case where the transfer unit 32A is mounted on the transfer unit mount portion 27 is different from that in a case where the transfer unit 32B is mounted on the transfer unit mount portion 27.

The transfer unit 32B includes the pre-transfer guide 16 serving as the recording material regulating member for regulating the transport path for the recording material. In addition, the transfer unit 32B is mounted with the pre-transfer guide positioning member 31B. It should be noted that the shape of the pre-transfer guide positioning member mounted on the transfer unit for the normal print is different from that of the pre-transfer guide positioning member mounted on the transfer unit for the margin-less print. Due to the difference between those shapes, the pre-transfer guide 16 mounted on the main body is regulated to be set in a position suitable for each print mode when each transfer unit is mounted on the main body. The second transfer roller 10B is similar to the second transfer roller used for the transfer unit for the normal print according to the first embodiment. In other words, a second transfer roller suitable for the normal print is adopted. As described above, the transfer unit for the normal print is structured.

In a similar manner as in the first embodiment, in the image forming apparatus according to this embodiment, the user selects one unit of the above-mentioned two transfer units and mounts the selected unit on the transfer unit mount portion 27, thereby performing the printing. In the vicinity of the transfer unit mount portion 27, the switch 28 is provided, thereby transmitting information indicating which of the transfer units 32A and 32B is mounted on the main body to the controller 6. When determining that the transfer unit 32A for the margin-less print is mounted on the main body, the controller 6 controls the image forming apparatus such that both the margin-less print and the normal image can be outputted as in the case of the image forming apparatus according to the first embodiment. When determining that the transfer unit 32B for the normal print is mounted on the main body, the controller 6 controls the image forming apparatus such that only the normal image can be outputted.

FIGS. 7A and 7B each are explanatory diagrams of the recording material transport path in a case where each of the transfer units is mounted on the main body to perform the secondary transfer.

FIG. 7A shows a recording material transport path in a case where the transfer unit for the margin-less print is mounted on the main body, and FIG. 7B shows a recording material transport path in a case where the transfer unit for the normal print is mounted on the main body. As described above, in this embodiment, the pre-transfer guide positioning members 31A and 31B mounted on the transfer units set the position of the pre-transfer guide 16 of the image forming apparatus main body, so the transport path for recording material can be changed to be set in an optimum position according to the type of the transfer unit.

In FIGS. 7A and 7B, reference symbol P denotes the recording material. In a case where the transfer unit for the margin-less print is mounted on the main body, the recording material P is brought into contact with the second transfer roller, and then enters the transfer area along the second transfer roller. On the other hand, in a case where the transfer unit for the normal print is mounted on the main body, the recording material P is brought into contact with the intermediate transfer belt, and then enters the transfer area along the transfer belt. In other words, the optimum transport path for the recording material can be set according to the respective transfer units (according to the respective print modes).

It should be noted that, in this embodiment, described is the method of automatically changing the position of the pre-transfer guide by regulating the settings of the pre-transfer guide serving as the recording material regulating member by the positioning member mounted on the transfer unit. However, the method of changing the position of the pre-transfer guide is not limited to this. For example, it is possible to change the position of the pre-transfer guide by providing a discriminating means for discriminating type of the transfer unit mounted on the main body, and driving the pre-transfer guide (recording material regulating member) by a motor or the like based on a discrimination result of the discriminating means.

As described above, in this embodiment, the image forming apparatus having the margin-less print mode is structured such that the user can exchangeably use the transfer unit used for the margin-less print and the transfer unit used for the prints other than the margin-less print (normal print). In addition, the recording material regulating member is varied in the optimum position according to the transfer unit mounted on the main body, thereby enhancing the quality of the margin-less print image, and obtaining the preferable image quality and the low printing cost even in the normal print mode.

Third Embodiment

Figure 8:
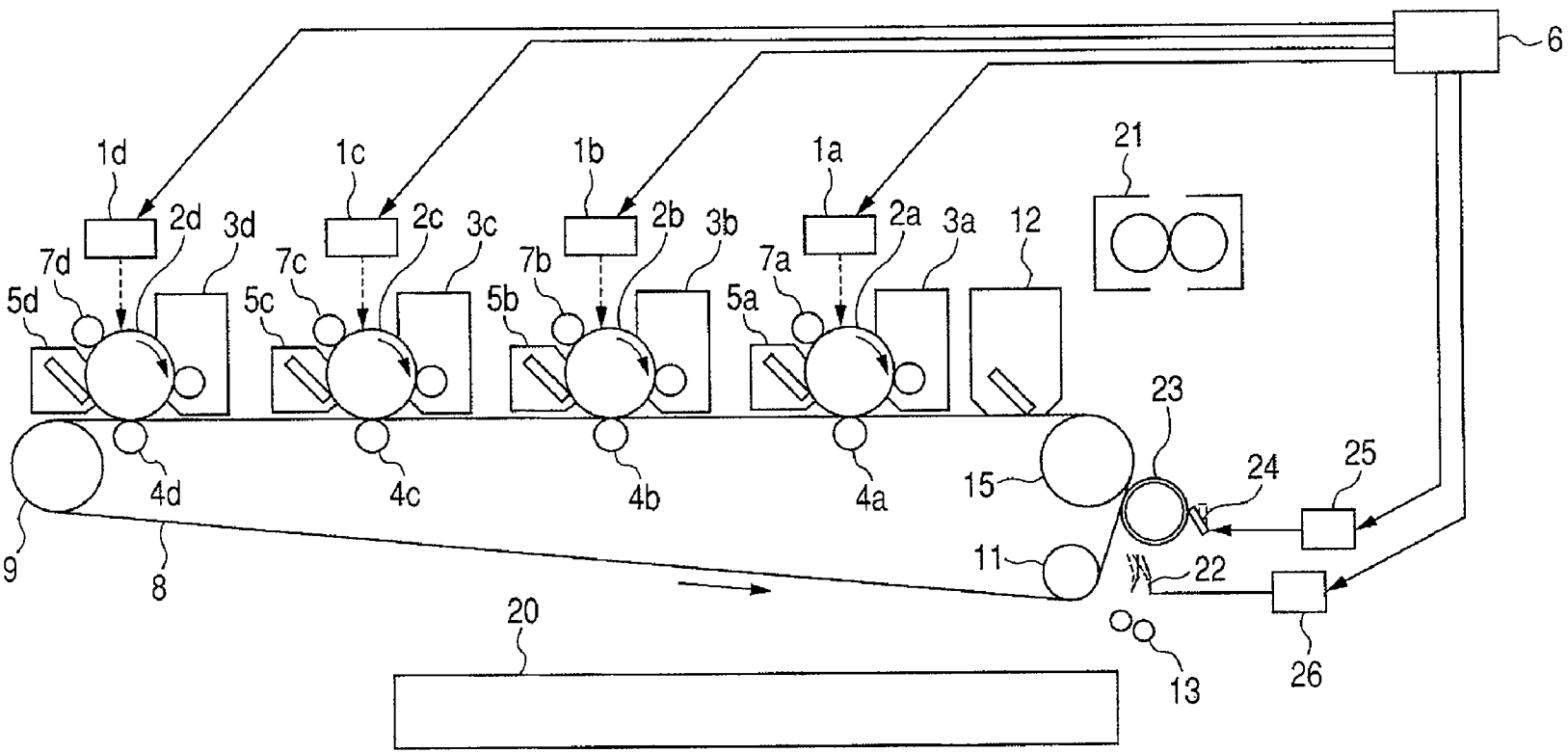
FIG. 8 is a cross-sectional diagram of an overall structure of an image forming apparatus according to a third embodiment of the present invention.

FIG. 8 is a schematic diagram of the structure of the image forming apparatus according to this embodiment. The same reference symbols denote the members that are identical with those of the image forming apparatus shown in FIG. 1 according to the first embodiment, and the repeated explanation thereof is omitted.

Also in this embodiment, similarly to the image forming apparatus according to the first embodiment, the toner images are superimposed on one another and transferred onto the intermediate transfer belt 8 to be secondarily transferred onto the recording material. Then, the thus transferred toner images are fixed on the recording material to be outputted as an image-formed matter.

Figure 9:
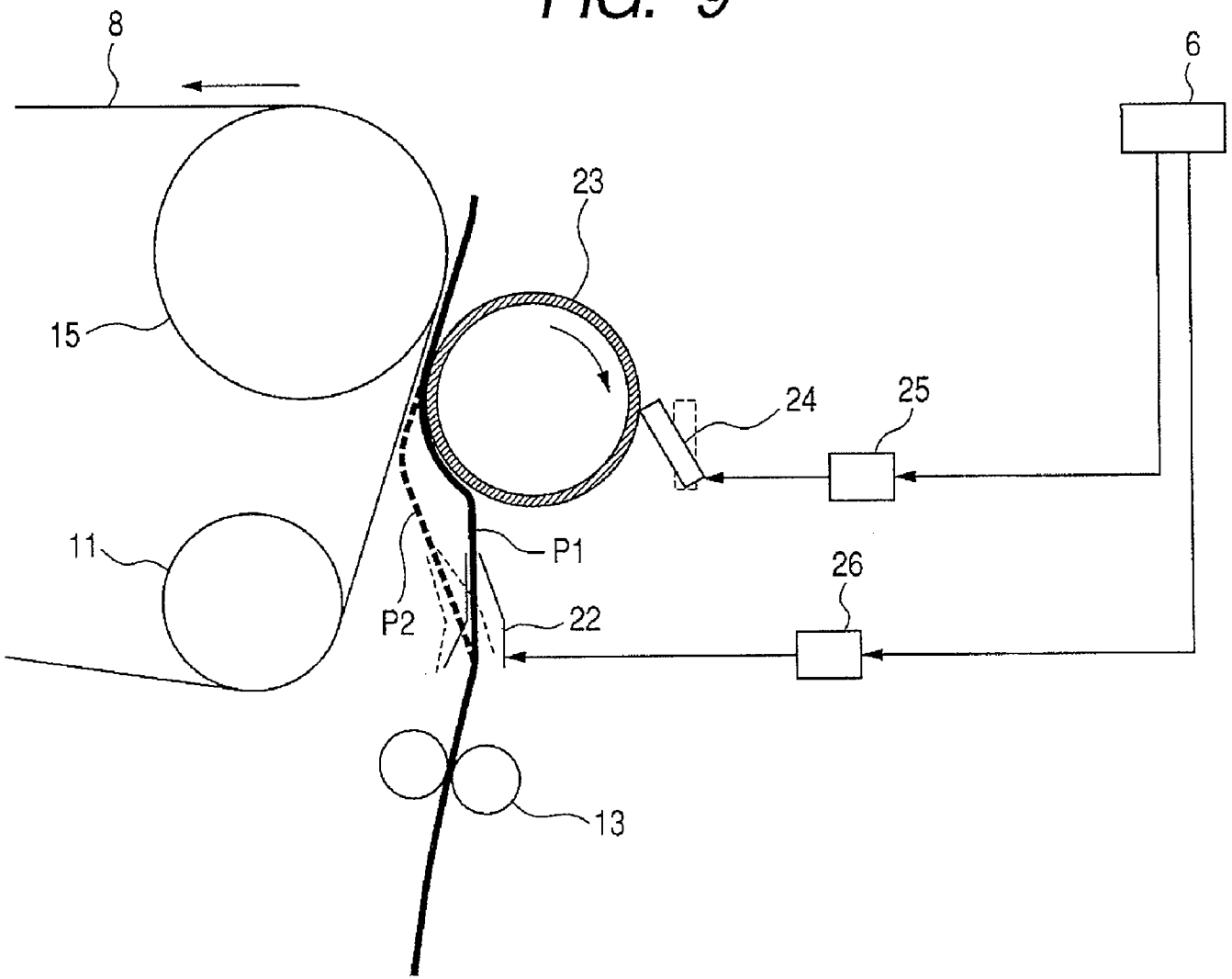
FIG. 9 is an explanatory diagram of a recording material transport path according to the third embodiment.

In the image forming apparatus according this embodiment, each position of a drive means 25 and the pre-transfer guide 16 (recording material regulating member) is changed by a control of the controller 6. In setting for the margin-less print, the controller 6 controls a set position of the pre-transfer guide 16 to be set for the margin-less print indicated by the solid line of FIG. 8. On the other hand, in setting for the normal print, the controller 6 controls the set position of the pre-transfer guide 16 to be set for the normal print indicated by the broken line of FIG. 8. Those positions are shown in FIG. 9 in more detail. The set position for the margin-less print is set such that the recording material enters the transfer area along the second transfer roller after being brought into contact with the second transfer roller. On the other hand, the set position for the normal print is set such that the recording material enters the transfer area along the transfer belt after being brought into contact with the intermediate transfer belt.

Further, a drive means 26 changes a set position of the second transfer roller cleaner 14, which is the plate-like blade made of polyurethane rubber, by the control of the controller 6. In the setting for the margin-less print, the controller 6 controls the second transfer roller cleaner 14 to be set in a position indicated by the solid line of FIG. 8. On the other hand, in the setting for the normal print, the controller 6 controls the set position of the second transfer roller cleaner 14 to be set for the normal print indicated by the broken line of FIG. 8. The set position of the second transfer roller cleaner 14 for the margin-less print is set to be brought into contact with the second transfer roller at a linear pressure of 30 N/m. On the other hand, the set position of the second transfer roller cleaner 14 for the normal print is set to be a position apart from the second transfer roller 10A by 5 mm.

In the image forming apparatus according to this embodiment, when the user selects the margin-less print, the controller 6 controls the pre-transfer guide 16 and the second transfer roller cleaner 14 to move into the set positions for the margin-less print. On the other hand, when the user selects the prints other than the margin-less print (normal print), the controller 6 controls the pre-transfer guide 16 and the second transfer roller cleaner 14 to move into the set position for the normal print.

A second transfer roller 23 has a layered structure (material) similar to that of the second transfer roller 10A used for the transfer unit for the margin-less print according to the first embodiment. The detailed structure thereof is shown in FIGS. 4A and 4B. This is because cleaning of the transfer roller is required in the case of the margin-less print. The outer diameter of the transfer roller 23 is set to be 40 mm so as to be compatible with both the margin-less print and the normal print.

FIG. 9 is an explanatory diagram of a recording material transport path in a case where the secondary transfer is performed. In FIG. 9, reference symbol P1 (solid line) denotes a recording material used for the margin-less print, and reference symbol P2 (broken line) denotes a recording material used for the normal print. In the case of the margin-less print, the recording material is brought into contact with the second transfer roller, and then enters the transfer area along the second transfer roller. In the case of the normal print, the recording material is brought into contact with the intermediate transfer belt, and then enters the transfer area along the transfer belt. In other words, the optimum transport path for the recording material can be set according to the respective print modes.

It should be noted that, in the image forming apparatus according to this embodiment, only a very little stain of toner on the second transfer roller is caused at the time of the normal print, so there is no fear that the stain of toner on a rear surface of paper is caused. Therefore, in the case of the normal print, the second transfer roller cleaner 14 is set to be a position apart from the second transfer roller 10.

However, in a case where the present invention is applied to an image forming apparatus in which a little stain of toner on the second transfer roller is caused (a little stain on the rear surface of paper is caused) in the normal print, the position of the second transfer roller cleaner 14 may be moved such that a contact pressure between the second transfer roller cleaner 14 and the second transfer roller becomes low. In other words, in the case of the margin-less print where the stain of toner on the second transfer roller 10 is caused to a large extent, the contact pressure between the blade (the second transfer roller cleaner 14) and the second transfer roller may be set to be high in order to enhance the cleaning performance. On the other hand, in the case of the normal print where the fear of the stain of toner on the second transfer roller 10 is less, the contact pressure between the blade and the second transfer roller may be set to be low. Further, when surface properties of the second transfer roller 10 are improved in terms of conditions of releasability of the toner or the like, it is possible that the contact pressure is maintained to be low without changing the contact pressure between the normal print mode and the margin-less print mode.

According to this embodiment, mainly described above is the method that, in the image forming apparatus having the margin-less print mode, in the case of printing the margin-less print, the recording material regulating member is moved to the optimum position for the margin-less print, and the contact pressure of the second transfer roller cleaning member is changed, thereby improving the quality of the margin-less print image, and maintaining the preferable image quality and the low printing cost even in a print mode other than the margin-less print (that is, normal print mode).

This application claims priority from Japanese Patent Application No. 2005-199777 filed Jul. 8, 2005, which is hereby incorporated by reference herein.

What is claimed is:

1. An image forming apparatus comprising:

an image bearing member configured to bear a toner image; and a transfer member configured to form a transfer area with said image bearing member, wherein the transfer member transfers the toner image from said image bearing member onto a recording material to be conveyed to the transfer area, wherein the image forming apparatus is operable in:

a margin-less print mode for forming the toner image onto the recording material without a margin on any one of the edges of the recording material; and a normal print mode for forming the toner image onto the recording material to provide margins on all of the edges of the recording material, wherein, when the margin-less print mode is carried out, the recording material first comes in contact with said transfer member, and then the recording material is conveyed to the transfer area, and wherein, when the normal print mode is carried out, the recording material first comes in contact with said image bearing member, and then the recording material is conveyed to the transfer area.

2. The image forming apparatus according to claim 1, further comprising:

a guide member configured to guide a conveying direction of the recording material to be conveyed to the transfer area, wherein said guide member has a first position in which the conveying direction is guided so that a leading edge of the recording material first comes in contact with said transfer member, and a second position in which the conveying direction is guided so that the leading edge of the recording material first comes in contact with said image bearing member, and wherein, when the margin-less print mode is carried out, said guide member is in the first position, and wherein, when the normal print mode is carried out, said guide member is in the second position.

3. The image forming apparatus according to claim 2, further comprising:

a transfer unit mount portion configured to mount a first transfer unit and a second transfer unit, said first transfer unit and said second transfer unit configured to transfer the toner image from said image bearing member onto the recording material, and said first transfer unit and said second transfer unit being replaceable one for the other, wherein, when said first transfer unit is mounted on said transfer unit mount portion, said guide member is in the first position, and wherein, when said second transfer unit is mounted on said transfer unit mount portion, said guide member is in the second position.

4. The image forming apparatus according to claim 1, wherein said image bearing member is an intermediate transfer belt.

* * * * *